US008474425B2

(12) United States Patent
Kirbach

(10) Patent No.: US 8,474,425 B2
(45) Date of Patent: Jul. 2, 2013

(54) SWITCHABLE ROLLER FINGER FOLLOWER

(75) Inventor: Lutz Kirbach, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 260 days.

(21) Appl. No.: 12/957,295

(22) Filed: Nov. 30, 2010

(65) Prior Publication Data

US 2011/0126787 A1 Jun. 2, 2011

Related U.S. Application Data

(60) Provisional application No. 61/265,453, filed on Dec. 1, 2009.

(51) Int. Cl.
*F01L 1/18* (2006.01)

(52) U.S. Cl.
USPC ..... 123/90.45; 123/90.39; 123/90.44

(58) Field of Classification Search
USPC ..... 123/90.16, 90.39, 90.43–90.45
See application file for complete search history.

(56) References Cited

U.S. PATENT DOCUMENTS

| | | | | |
|---|---|---|---|---|
| 6,769,387 | B2 * | 8/2004 | Hayman et al. | 123/90.39 |
| 6,976,461 | B2 * | 12/2005 | Rorig et al. | 123/90.16 |
| 7,730,861 | B2 * | 6/2010 | Ng | 123/90.39 |
| 7,934,477 | B2 * | 5/2011 | Elnick et al. | 123/90.16 |
| 7,980,216 | B2 * | 7/2011 | Elnick et al. | 123/90.44 |
| 2003/0209217 | A1 * | 11/2003 | Hendriksma et al. | 123/90.44 |

* cited by examiner

*Primary Examiner* — Thomas Denion
*Assistant Examiner* — Daniel Bernstein
(74) *Attorney, Agent, or Firm* — Lucas & Mercanti, LLP

(57) ABSTRACT

The finger follower employs two independent lost motion arms and a rod which moves longitudinally to lock both arms. The rod is transversely mounted in the follower. In order to avoid premature locking, a clip is employed with tabs that interact with end surfaces of the arms so as to prevent premature movement of the rod from an unlocked position to a locked position.

8 Claims, 7 Drawing Sheets

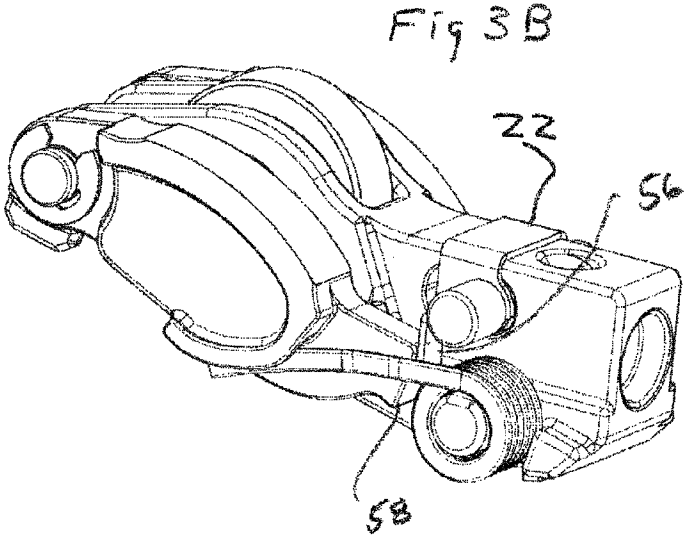
Fig 3A
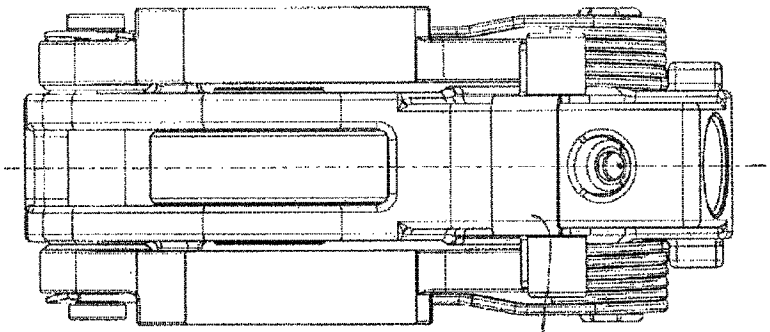
Fig 3C
Fig 3B
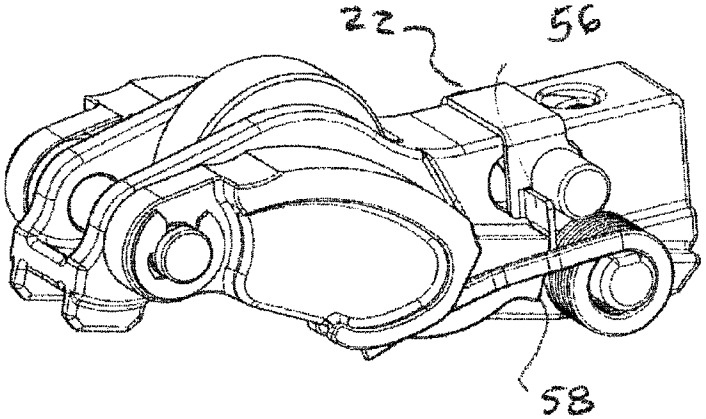
Fig 3D

22

22

22

74
22

22

76
56
22
76
56

10
84
43

84
43

10

84

86
84

84

84

86
84

86
84

SWITCHABLE ROLLER FINGER FOLLOWER

This application claims the priority of 61/265,453 filed Dec. 1, 2009, which is incorporated by reference herein.

FIELD OF INVENTION

This Invention relates to internal combustion engines and more particularly to switchable roller finger followers used in overhead cam engines where the finger followers can be deactivated in order to deactivate an intake and/or exhaust valve, or to switch between two different lift profiles, a high lift and a low lift profile.

BACKGROUND OF INVENTION

Switchable roller finger followers are known, see, for example, U.S. Pat. No. 7,174,869. Such finger followers have an outer lever pivotably mounted outside an inner lever and a roller rotatably mounted in a slot in the inner liner. The top surface of the outer lever acts as a contact surface for a high lift cam and the top surface of the roller acts as a contact surface for a low lift cam. A coupling element is mounted at one end of the finger and oil from an oil source is used to activate the coupling element. When the coupling element is activated, it locks the outer lever to the inner lever and requires the follower to follow both the high lift cam and the low lift cam. When the coupling element is deactivated, the outer lever is free to pivot and, under the aid of a spring, the outer lever pivots freely in conjunction with the high lift cam. This movement by the outer lever is conventionally referred to as the lost motion stroke.

Conventionally, the outer lever is a unitary structure such that the coupling element need only operate as one part of the outer lever. Typically, the coupling device operated on a yoke portion of the outer layer, the yoke portion being transverse to the longitudinal axis of the finger follower.

SUMMARY OF INVENTION

The Invention is directed to a finger follower where the outer lever is designed as two separate outer arms, which are not joined by a transverse yoke and which can freely move independent of one another and a coupling element that operates on both arms simultaneously to simultaneously lock both arms.

Also, the Invention provides a coupling element that can be activated at any point during the pivotal movement of the arms, at any point during the lost motion stroke, but that locks the arms only when the arms are in a base position.

The Invention can be defined as, in a switchable finger follower of the type having two separate outer arms pivotally mounted at one end of an inner lever, a roller rotatably mounted in a slot in the inner lever, the outer arms extending longitudinally towards the other end of the inner lever and a coupling element mounted in the other end of the inner lever, wherein the coupling element has a rod extending laterally from each side wall of the inner lever and the rod is longitudinally movable into and out of engagement with a locking surface of the arms, to lock and unlock the arms in a base position.

In order to lock the arms only when the arms are in the base position, a clip is mounted on the rod and movable with the rod, the clip has two tabs, one of each of the tabs opposing a lateral end surface of one of each of the arms when the arms are in the down position thereby preventing the rod from moving into engagement with the top surface of the arms when the arms are in the down position.

Broadly, the Invention can be defined as follows:

A switchable finger follower for a valve train of an internal combustion engine, comprising:

a longitudinally extending, inner lever having a bottom wall with a valve stem support at one end of the lever and a lash adjuster contact surface at the other end of the lever and a slot extending through the lever from the bottom wall to a top wall of the lever;

a roller mounted in the slot;

two separate, longitudinally extending outer arms, one end of each of the arms pivotally mounted at the one end of the lever, one of each of the arms mounted along one longitudinal sidewall of the lever and the other end of each of the arms extending towards the other end of the lever, each of the arms moving between the down position and a base position;

a restoring spring means for restoring the arms to the base position; and a coupling element mounted in a lateral end wall at the other end of the lever, the coupling element having a rod extending laterally from each longitudinal sidewall of the inner lever, the rod longitudinally movable into and out of engagement with a locking surface at the other end of the arms to lock and unlock the arms in the base position.

To avoid the rod from longitudinally moving into engagement with the top surface of the arms, a clip is mounted on the rod and movable with the rod, the clip has two tabs, one of each of the tabs opposing a lateral end surface of one of each of the arms when the arms are in the down position thereby preventing the rod from moving into engagement with the arms when the arms are in the down position.

Preferably, the coupling element comprises:

a longitudinal extending blind bore extending from a lateral end wall at the other end of the lever into the lever;

a transverse, oblong hole extending from one longitudinal sidewall to the other longitudinal sidewall of the lever, the oblong hole transversely bisecting the blind bore;

the rod mounted in the oblong hole to transverse the blind bore;

a spring mounted in the blind bore at the blind end;

a longitudinally movable piston mounted in the blind bore on top of the spring, the piston, engaged with the rod and longitudinally movable therewith; and an end cap closing the blind bore and forming an oil chamber between the end cap and the piston for receiving fluid pressure from a lash adjuster, such that the fluid pressure forces the piston into the blind bore which longitudinally moves the rod into engagement with the other end of the arms.

Preferably, the clip is a U shaped sheet metal piece where the bottom of the U laterally spans the top wall of the lever and each leg of the U extends downward along the sidewalls of the lever, each leg of the U engages the rod to mount the clip on the rod, one of each of the tabs is formed on each leg of the U at a bottom of the leg of the U, the tab extending transversely to a longitudinal axis of the lever.

Preferably, the rod has two circumferential grooves, one of each of the grooves located adjacent the longitudinal sidewalls of the lever and the clip has two C-shaped sections, one of each of the sections engages one of each of the grooves to mount the clip on the rod.

Preferably, the restoring spring means is two restoring springs which are each a torsion spring, each spring is mounted on a post extending transversely outward from the longitudinal sidewall, and each spring has a long leg which abuts the arm and a short leg that abuts a stop, the stop is affixed to the lever.

These and other aspects of the Invention may be more readily understood by reference to one or more of the following drawings.

BRIEF DESCRIPTION OF THE DRAWINGS

FIGS. 3A-3D illustrate the follower wherein the clip is preventing the locking element from locking the outer arms in the locked position;

DETAILED DESCRIPTION OF THE INVENTION

Figures 1A, 1B, 1C, 1D:
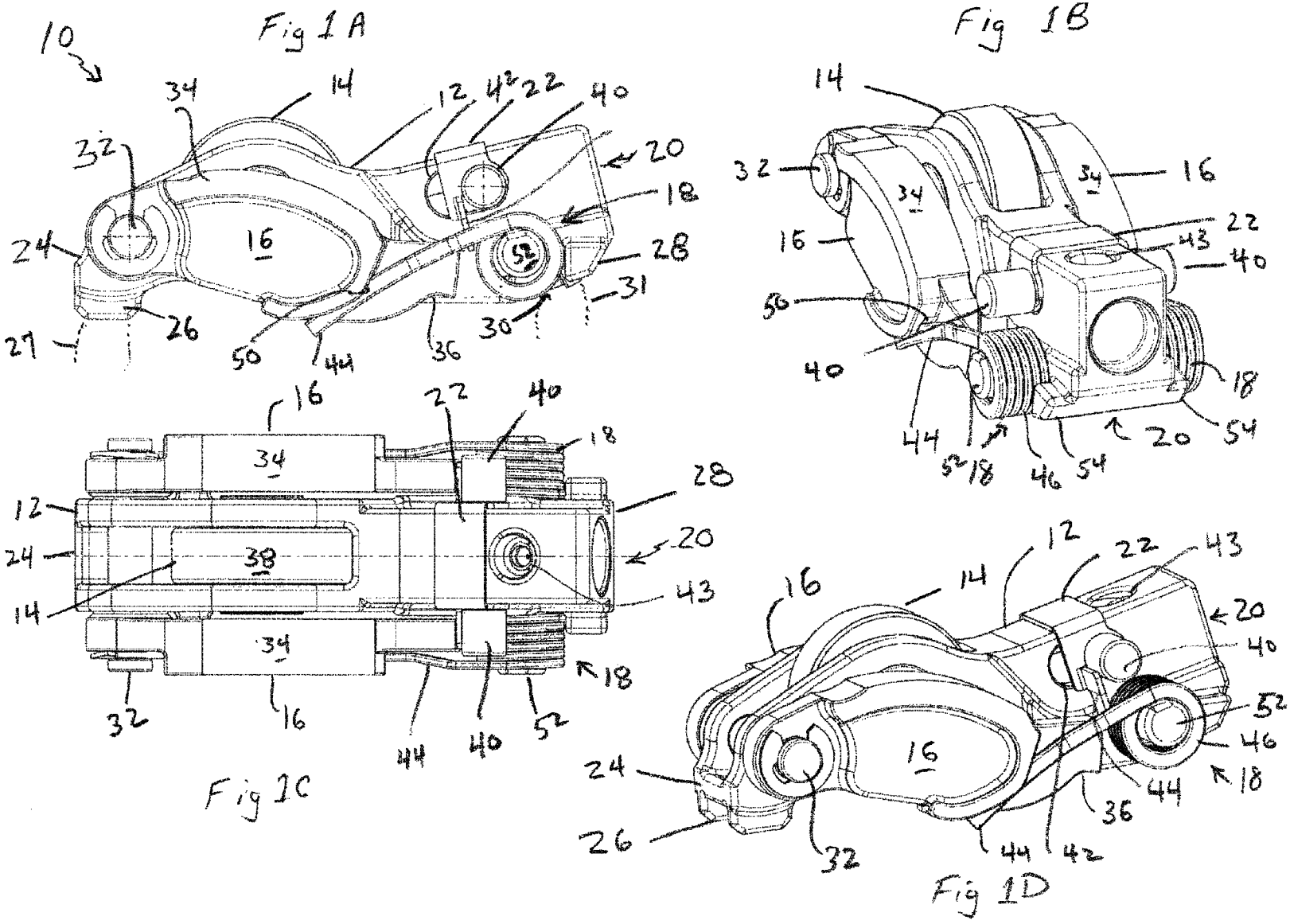
FIGS. 1A-1D illustrate the follower in an un-locked position.

Turning to FIGS. 1A-1D, FIG. 1A is a side view of switchable finger follower 10. Switchable finger follower 10 has inner lever 12 in which roller 14 is housed. Outer arms 16 are pivotably mounted on inner lever 12. Torsion springs 18 acts on outer arms 16 to restore outer arms 16 to a base position. The base position of outer arms 16 are shown in FIGS. 2A-2D. Coupling element 20 when activated locks outer arms 16 into the base position as shown in FIGS. 2A-2D. Clip 22 blocks the movement of coupling element 20 from locking arms 16 until arms 16 are in the base position.

Lever 12 has valve stem end 24 with valve stem support 26 thereon. Valve stem support 26 contacts and supports valve stem 27. Lash adjuster end 28 of lever 12 has contact surface 30 for lash adjuster 31.

Each outer arm 16 is pivotable on lever 12 by means of rod 32. Each arm 16 has cam contact surface 34 and locking surface 36. Locking surface 36 is on a bottom surface of arm 16 and interacts with coupling element 20 to lock arms 16 into the base position.

Roller 14 has cam contact surface 38. As will be understood, finger follower 10 is intended for use with an overhead cam engine wherein cam contact surface 34, and cam contact surface 38 interact with an overhead cam, not shown, so as to effect movement of the valve connected to valve stem 27.

Coupling element 20 has rod 40 which can move longitudinally in oblong hole 42. The movement of rod 40 is activated through oil pressure supplied by lash adjuster 31 through an inlet in contact surface 30. To deactivate coupling element 20, the supply of oil is stopped from lash adjuster 31 and oil can escape from coupling element 20 through outlet 43.

FIGS. 1A through 1D illustrate switchable finger follower 10 in a deactivated or unlocked mode. FIG. 1A is a side view of switchable finger follower 10, FIG. 1B is a perspective view of finger follower 1B from the lash adjuster end of the finger follower 10. FIG. 1C is a top view of switchable finger follower 10 and FIG. 1D is a perspective view of finger follower 10 from valve stem end of finger follower 10.

FIGS. 2A-2D illustrate switchable finger follower 10 in the locked mode wherein rod 40 has moved longitudinally towards valve stem end 24 of finger follower 10 and rod 40 has contacted locking surface 36 of each arm 16. As shown in FIGS. 2A-2D, arms 16 are in the base position and are locked to move with inner lever 12. In FIGS. 1A-1D, arms 16 are not locked and thus move independent of inner lever 12.

Arms 16 are acted on by torsion spring 18 which has long leg 44 and coils 46 and short leg 48. Long leg 44 acts on contact surface 50 of arms 16. Torsion spring 18 is mounted on posts 52 of inner lever 12 and short leg 48 abuts stops 54 which are part of inner lever 12.

Figure 2B:
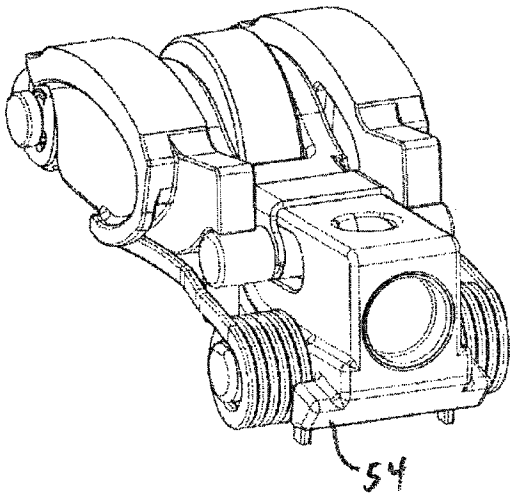
FIGS. 2A-2D illustrate the follower in a locked position.
Figure 2D:
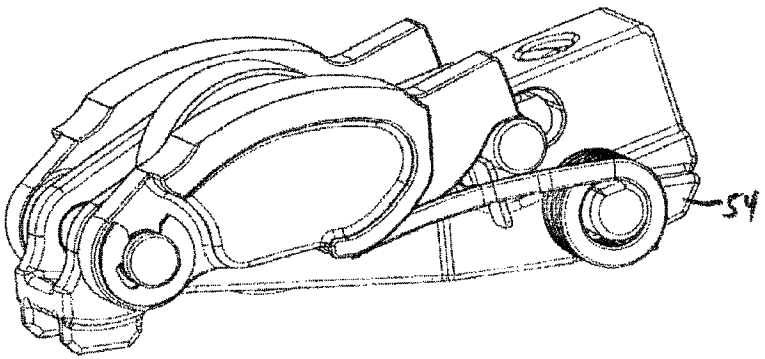
Figure 2A:
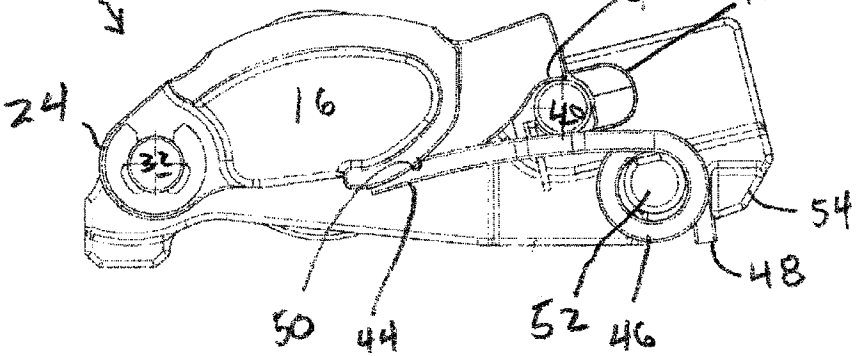
Figure 2C:
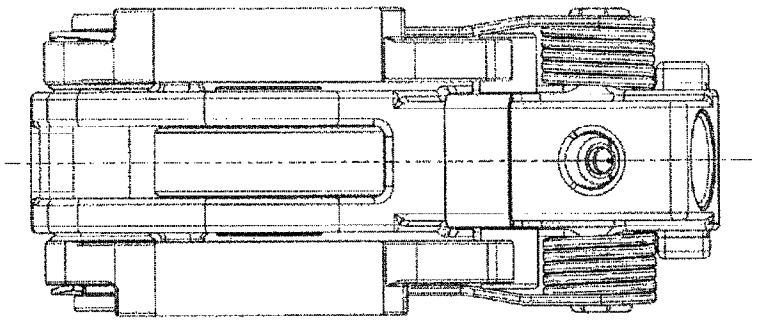

FIG. 2A is a side view of finger follower 10 in the locked mode, FIG. 2B is a perspective view of finger follower 10 from lash adjuster end 28 in the locked mode; FIG. 2C is a top view of lash adjuster 10 in the lock mode and FIG. 2D is a perspective view of finger follower 10 in the lock mode from valve stem end 24.

FIGS. 3A-3D illustrate switchable finger follower 10 wherein clip 22 is shown with tab 56 abutting lateral end surface 58 of outer arms 16. Tab 56 is spaced away from lateral end surface 58 in FIGS. 1A-1D because rod 32 is positioned toward lash adjuster end 28 of lever 12 and arms 16 freely pivot on rod 32. When coupling element 20 proceeds to move into locked position as illustrated in FIGS. 2A-2D, rod 40 moves in oblong hole 42 towards valve stem end 24 of lever 12. When arm 16 is not in the base position as shown in FIGS. 2A-2D, tab 56 has moved forward and makes contact with lateral end surface 58. This contact between tab 56 and end surface 58 prevents rod 40 from advancing until such time as arm 16 is in the base position as illustrated in FIGS. 2A-2D. This provides for proper locking of arms 16 and prevents improper operation of coupling element 20. As can be seen, spring 18 moves arms 16 and end surface 58 past tabs 56 as arm 16 moves upward. Once end surface 58 has cleared tab 56, rod 40 is free to move longitudinally towards valve stem end 24 and rod 40 will then contact locking surface 36 to lock arm 16 into the base position as illustrated in FIGS. 2A-2B.

FIG. 3A illustrates a side view of switchable finger follower 10 wherein tab 56 abuts end surface 58. FIG. 3B is a perspective view of finger follower 10 from the lash adjuster end. FIG. 3C is a top view of finger follower 10 and FIG. 3D is a perspective view of follower 10 from the valve stem end. In each FIGS. 3A-3D, tab 56 is abutting end surface 58.

Figure 4:
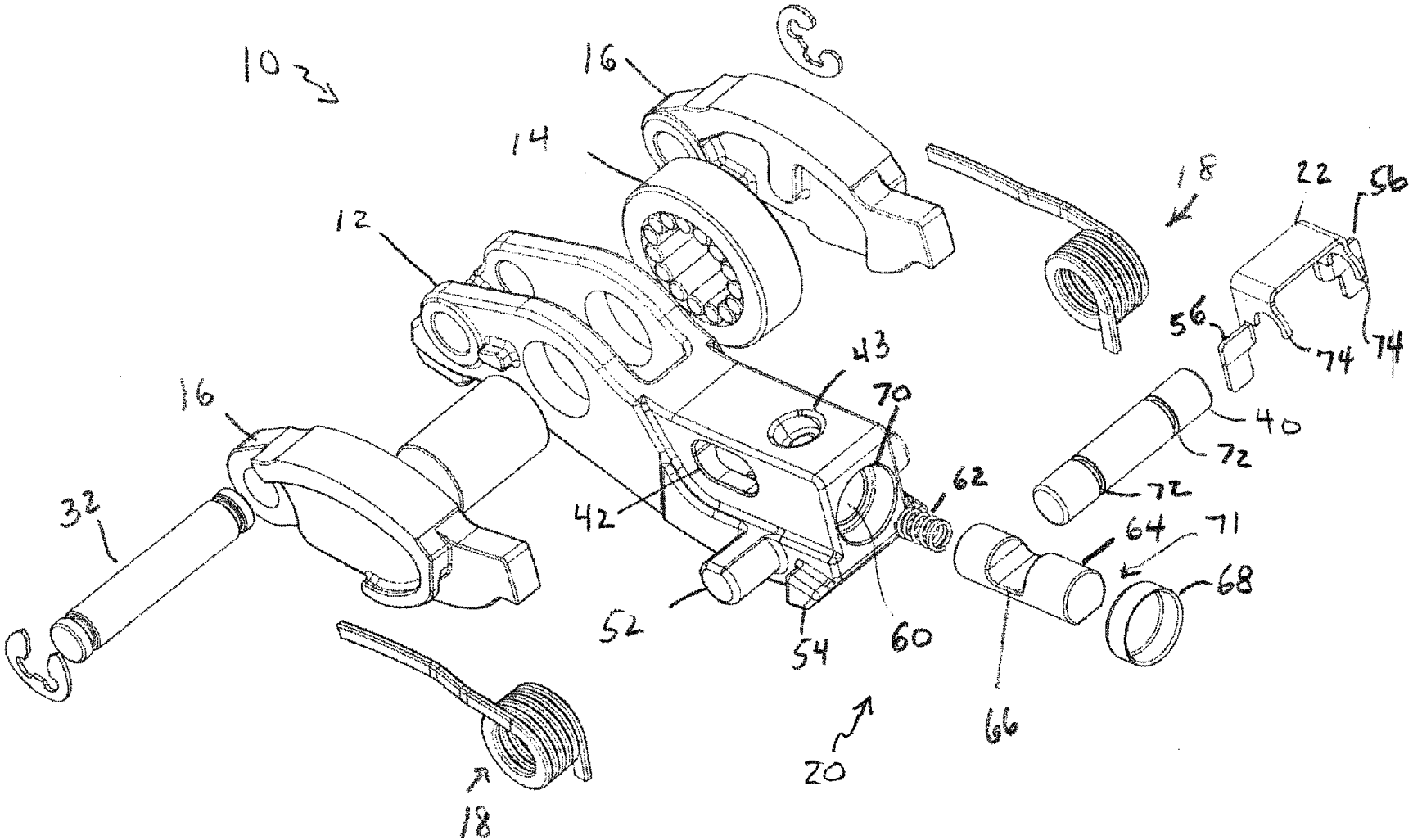
FIG. 4 illustrates an exploded view of the follower.

FIG. 4 is an exploded view of finger follower 10. Shown in FIG. 4, coupling element 20 has blind bore 60 which extends longitudinally in lash adjuster end 28 of lever 12. As can be seen, oblong hole 42 transversely bisects blind bore 60. Additionally, outlet 43 bisects blind bore 60. Inside blind bore 60 is mounted coil spring 62 and piston 64. Piston 64 has cut out 66 for engagement with rod 40 when rod 40 is positioned in oblong hole 42. End cap 68 closes opening 70 of blind bore 60 and forms oil chamber 71 between the inside wall of end cap 68 and the end wall of piston 64 for receiving oil pressure from lash adjuster 31. Oil pressure is provided from lash adjuster 31 through an inlet in the lash adjuster contact surface 30 to oil chamber 71 to move piston 64 longitudinally in blind bore 60 and thereby move rod 40 in oblong hole 42. When oil pressure is released, coil spring 62 moves rod 40 towards lash adjuster end 28 of lever 12. This movement by coil spring 62 forces oil out of blind bore 60 through outlet 43. The control and supplying of oil through lash adjuster 31 in order to control the movement of rod 40 and the overall locking and unlocking of coupling element 20 is done in conventional manner using conventional equipment.

Rod 40 has circumferential grooves 72. Circumferential grooves 72 are designed to interact with C-shaped sections 74 of tab 22. C-sections 74 fit into circumferential grove 72 such that clip 22 moves with rod 40 as rod 40 moves back and forth in oblong hole 42.

Figures 5A, 5B, 5C, 5D, 5E, 5F:
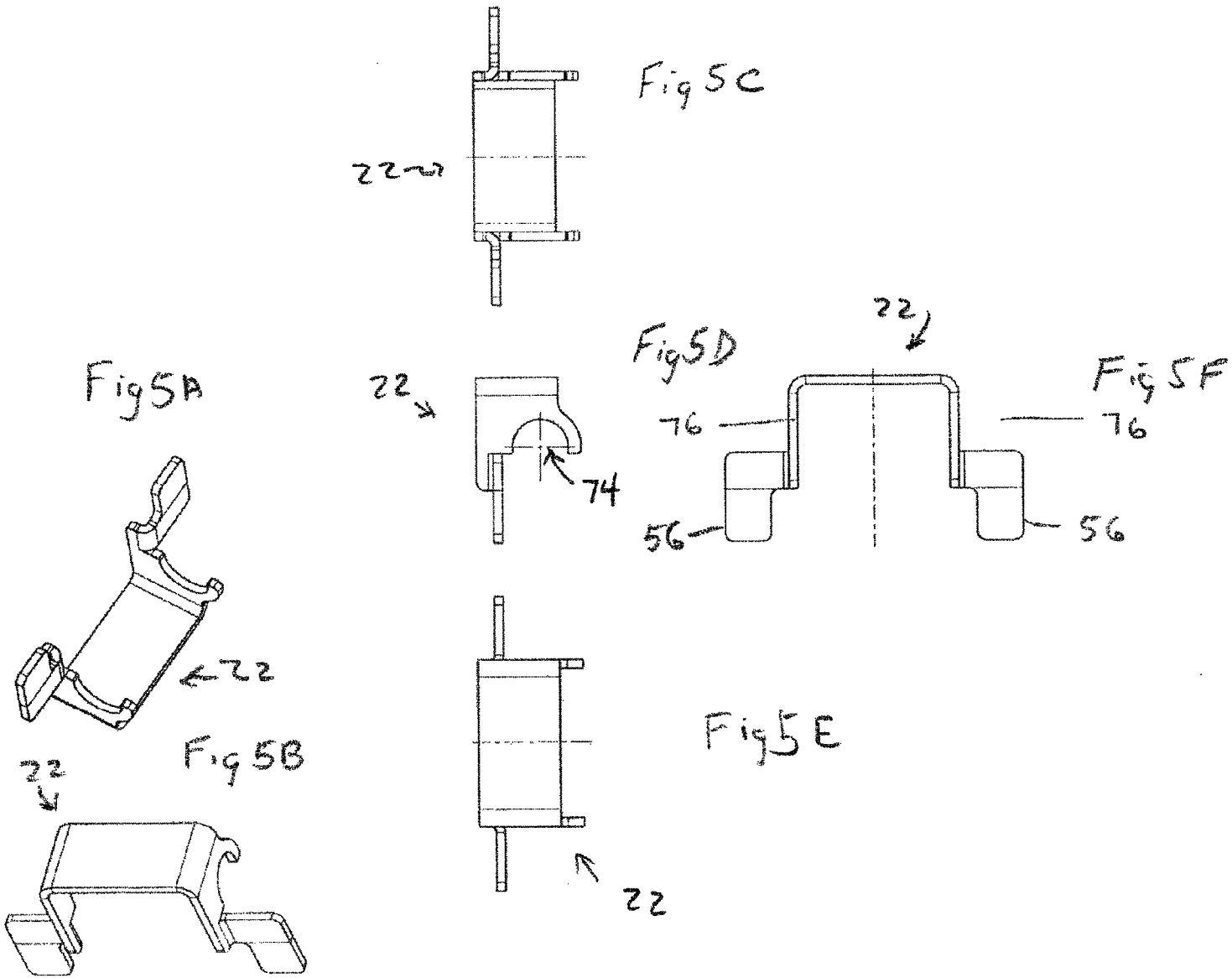
FIG. 5A-5F illustrates the clip of the Invention.

FIGS. 5A through 5F illustrate clip 22 in more detail. FIG. 5A is a perspective view of clip 22 shown from the bottom while FIG. 5B is a perspective top view of clip 22. FIG. 5C is the bottom view of clip 22, FIG. 5D is a side view of clip 22.

FIG. 5E is a top view of clip 22 and FIG. 5F is a front view. As can be seen in FIGS. 5A-5F, clip 22 is suitably made of sheet metal and has an overall U-shaped configuration with the bottom of U-shaped clip 22 designed to slide along the top wall of lever 12. Each leg 76 of clip 22 has C-shaped sections 74 for interacting with groove 72 of rod 40. Tabs 56 are formed at the bottom of leg 76 and have been bent outward at approximately a 90° angle from leg 76.

Figure 6G:
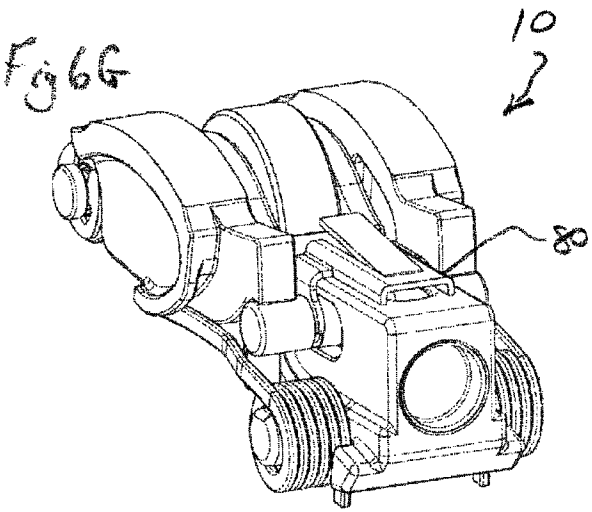
FIG. 6A-6H illustrate the clip with an oil spray guide and the follower with the clip with the oil spray guide.
Figure 6H:
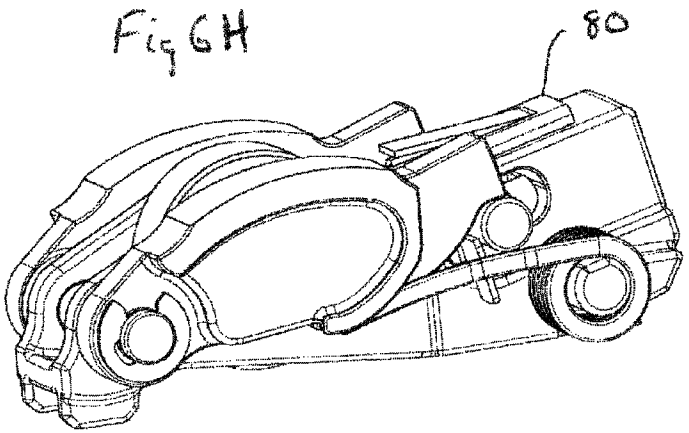
Figure 6C:
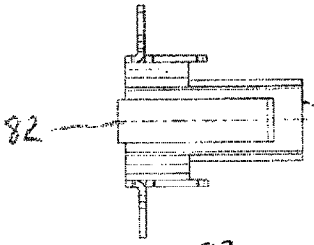
Figure 6F:
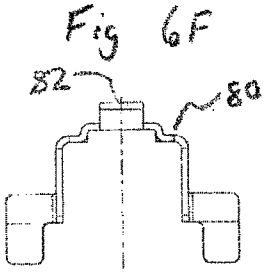
Figure 6D:
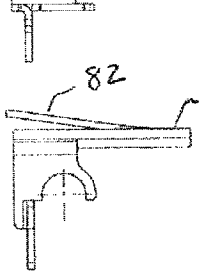
Figure 6E:
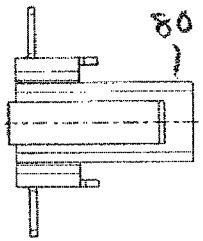
Figure 6A:
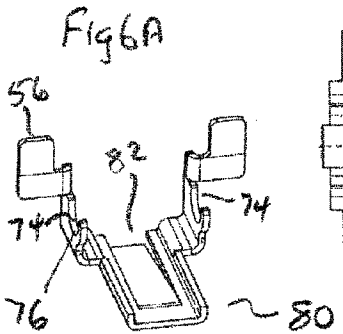
Figure 6B:
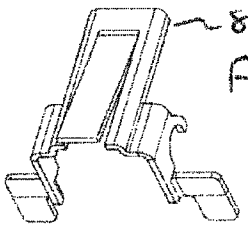

FIGS. 6A-6H illustrates an alternative embodiment of a clip of the present Invention. Specifically, clip 80 is illustrated in FIGS. 6A-6H wherein clip 80 has oil spray guide 82. FIG. 6A is a bottom perspective view of clip 80, FIG. 6B is a top perspective view of clip 80, FIG. 6C is a bottom view of clip 80, FIG. 6D is a side view of clip 80, FIG. 6E is a top view of clip 80, FIG. 6F is a front view of clip 80, FIG. 6G is a perspective view of switchable finger follower 10 having clip 80 mounted thereon wherein switchable finger follower 10 is in a locked position and is a perspective view taken from lash adjuster end 24. FIG. 6H is a perspective view of finger follower 10 with clip 80 taken from valve stem end 24. As can be seen in FIGS. 6G and 6H, oil which is expelled through outlet 43 contacts oil spray guide 82 and is directed towards roller 14.

Figures 7A, 7B, 7C, 7D, 7E, 7F, 7G, 7H:
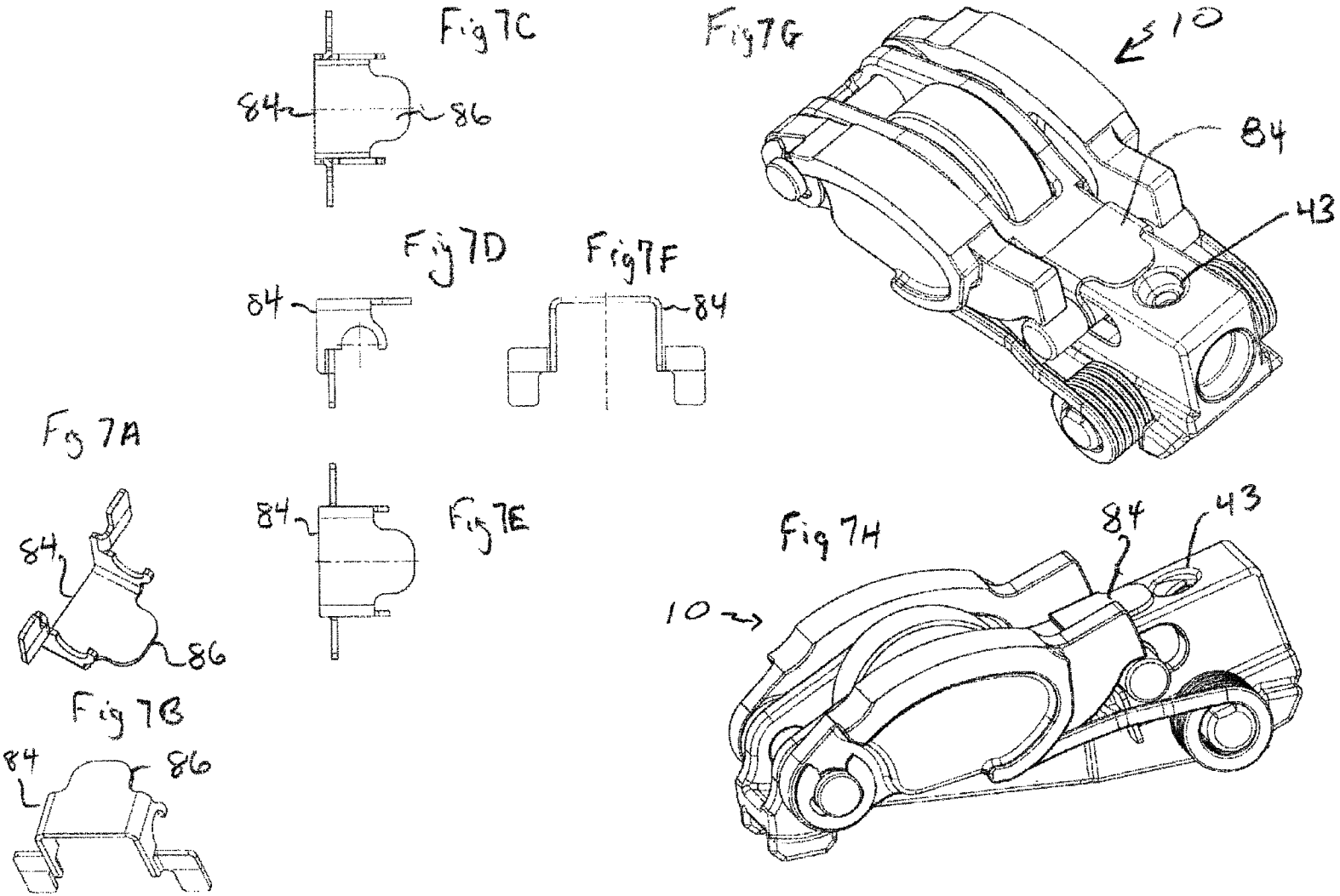
FIGS. 7A-7H illustrates the clip with a throttling function and the follower with the clip with the throttling function.

FIGS. 7A through 7H illustrate another alternative embodiment of the clip of the present Invention. Specifically, clip 84 having throttle element 86. FIG. 7A is a perspective bottom view of clip 84 with throttle element 86, FIG. 7B is a top perspective view of clip 84 with throttle element 86, FIG. 7C is a bottom view of clip 84, FIG. 7D is a side view of clip 84, FIG. 7E is a top view of clip 84, FIG. 7F is a front view of clip 84, FIG. 7G and 7H are perspective views of switchable finger follower 10 with clip 84 mounted thereon. Perspective views 7G and 7H of finger follower 10 illustrate the finger follower in a locked mode. As can be seen, when finger follower 10 moves from a locked mode to the unlocked mode, throttle element 86 moves over outlet 43 to throttle the outlet of oil coming from blind bore 60.

As will be appreciated by those of skill in the art, when the signal is given to couple arms 16 with inner lever 12, the signal is given independent of the actual location of arms 16. Tabs 56 in conjunction with end surface 58 provide that the arms are not locked in the partial or full lost motion stroke until such time as the arms are in the base position.

Clip 22, 80 and 84 are suitably made of stamped and heat treated sheet metal.

Reference Characters

10 Switchable finger follower
12 inner lever
14 roller
16 outer arms
18 torsion springs
20 coupling element
22 clip
24 valve stem end of lever
26 valve stem support
27 valve stem
28 lash adjuster end of lever
30 contact surface lash adjuster
31 lash adjuster
32 rod
34 cam contact surface of arms
36 locking surface
38 cam contact surface of roller
40 rod
42 oblong hole
43 outlet
44 long leg
46 coil
48 short leg
50 contact surface
52 post
54 stop
56 tabs
58 lateral end surface
60 blind bore
62 coil spring
64 piston
66 cut out
68 end cap
70 opening
71 oil chamber
72 circumferential grooves
74 C-shaped sections
76 leg Reference Characters (Continued)

80 clip
82 oil spray guide
84 clip
86 throttle element

What I claim is:

1. A switchable finger follower for a valve train of an internal combustion engine, comprising:

a longitudinally extending, inner lever having a bottom wall with a valve stem support at one end of the lever and a lash adjuster contact surface at the other end of the lever and a slot extending through the lever from the bottom wall to a top wall of the lever;

a roller mounted in the slot;

two separate, longitudinally extending outer arms, one end of each of the arms pivotally mounted at the one end of the lever, one of each of the arms mounted along one longitudinal sidewall of the lever and the other end of each of the arms extending towards the other end of the lever, each of the arms moving between a down position and a base position;

a spring means for restoring the arms to the base position; and a coupling element mounted in a lateral end wall of the other end of the inner lever, the coupling element having a rod extending laterally from each longitudinal side wall of the inner lever, the rod being movable in a longitudinal direction of the inner lever into and out of engagement with a locking surface at the other end of the arms to lock and unlock the arms in the base position.

2. The follower of claim 1 further comprising:

a clip mounted on the rod and movable with the rod, the clip has two tabs, one of each of the tabs opposing a lateral end surface of one of each of the arms when the arms are in the down position thereby preventing the rod from moving into engagement with the top surface of the arms when the arms are in the down position.

3. The follower of claim 1, wherein the coupling element comprises:

a longitudinally extending blind bore extending from the lateral end wall of the other end of the lever into the lever;

a transverse, oblong hole extending from one longitudinal side wall to the other longitudinal side wall of the lever, the oblong hole transversely bisecting the blind bore;

the rod mounted in the oblong hole to transverse the blind bore;

a spring mounted in the blind bore at the blind end;

a longitudinally movable piston mounted in the blind bore on top of the spring, the piston engaged with the rod and longitudinally movable therewith; and an end cap closing the blind bore and forming an oil chamber between the end cap and the piston for receiving fluid pressure from a lash adjuster, such that the fluid pressure forces the piston into the blind bore which longitudinally moves the rod into engagement with the other end of the arms.

4. The follower of claim 2, wherein the clip is U-shaped sheet metal piece where the bottom of the U laterally spans the top wall of the lever and each leg of the U extends downward along the side walls of the lever, each leg of the U engages the rod to mount the clip on the rod, one of each of the tabs is formed on each leg of the U at a bottom of the leg of the U, the tab extending transversely to a longitudinal axis of the lever.

5. The follower of claim 2, wherein the rod has two circumferential grooves, one of each of the grooves located adjacent to longitudinal side walls of the lever and the clip has two C-shaped sections, one of each of the C-shaped sections engages one of each of the grooves to mount the clip on the rod.

6. The follower of claim 4, wherein the rod has two circumferential grooves, one of each of the grooves located adjacent to longitudinal side walls of the lever and each leg of the U has a C-shaped section for engaging the one of each of the grooves in the rod.

7. The follower of claim 1, wherein the spring means is two restoring springs mounted at the other end of the lever, one of each of the springs acting on one of each of the arms to restore the arms to the base position from the down position.

8. The follower of claim 7, wherein the two restoring springs are each a torsion spring, each spring is mounted on a post extending transversely outward from the longitudinal side wail, and each spring has a long leg which abuts the arm and a short leg that abuts a stop, the stop affixed to the lever.

* * * * *